US007264580B2

(12) United States Patent
Lu

(10) Patent No.: US 7,264,580 B2
(45) Date of Patent: Sep. 4, 2007

(54) EXERCISING BALANCE BOARD

(76) Inventor: Ko-Chin Lu, 7F-1, No. 337, Sec. 4, Hsin Yi Rd., Taipei (TW)

( * ) Notice: Subject to any disclaimer, the term of this patent is extended or adjusted under 35 U.S.C. 154(b) by 0 days.

(21) Appl. No.: 11/258,503

(22) Filed: Oct. 25, 2005

(65) Prior Publication Data

US 2006/0105895 A1 May 18, 2006

(30) Foreign Application Priority Data

Nov. 12, 2004 (TW) ..... 93218157 U

(51) Int. Cl.
*A63B 22/16* (2006.01)
*A63B 23/08* (2006.01)

(52) U.S. Cl. ..... 482/146; 482/79

(58) Field of Classification Search ..... 482/80, 482/147, 51, 146, 79, 110; 273/444, 449; 472/135; *A63B 22/16*
See application file for complete search history.

(56) References Cited

U.S. PATENT DOCUMENTS

| | | | | |
|---|---|---|---|---|
| 3,984,100 | A * | 10/1976 | Firster | 482/79 |
| 5,292,296 | A * | 3/1994 | Davignon | 482/146 |
| 5,810,703 | A * | 9/1998 | Stack | 482/146 |
| 5,810,751 | A * | 9/1998 | Meier et al. | 601/24 |
| 5,867,583 | A * | 2/1999 | Hazelwood et al. | 381/395 |
| 2004/0018924 | A1 * | 1/2004 | Szydlowski et al. | 482/146 |
| 2004/0110604 | A1 * | 6/2004 | Chen Wu | 482/79 |

* cited by examiner

*Primary Examiner*—Cary E. O'Connor
*Assistant Examiner*—Sundhara M. Ganesan
(74) *Attorney, Agent, or Firm*—Alan Kamrath; Kamrath & Associates PA

(57) ABSTRACT

An exercising balance board includes a pedal, and a plurality of balance seats selectively mounted on the bottom of the pedal. Thus, the exercising balance board has an adjustable height by the balance seats and an adjustable curvature by the convex portion of each of the balance seats, so that the exercising balance board is available for users of different statures and requirements, thereby enhancing the versatility of the exercising balance board.

12 Claims, 6 Drawing Sheets

EXERCISING BALANCE BOARD

BACKGROUND OF THE INVENTION

1. Field of the Invention

The present invention relates to a balance board, and more particularly to an exercising balance board.

2. Description of the Related Art

A conventional exercising balance board 10 in accordance with the prior art shown in FIG. 7 comprises a pedal 11, and a convex portion 12 integrally formed on the bottom of the pedal 11. Thus, when a user steps on the top of the pedal 11, he has to change his center of gravity to balance the pedal 11, thereby achieving an amusement effect, and thereby exercising his body. However, the convex portion 12 is fixed on the pedal 11, so that the exercising balance board 10 has fixed height and curvature. Thus, the exercising balance board 10 is not available for users of different statures and requirements, thereby limiting the versatility of the exercising balance board.

SUMMARY OF THE INVENTION

In accordance with the present invention, there is provided an exercising balance board, comprising a pedal, and a plurality of balance seats selectively mounted on a bottom of the pedal.

The primary objective of the present invention is to provide an exercising balance board having an adjustable height to fit users of different statures and requirements.

Another objective of the present invention is to provide an exercising balance board, wherein the exercising balance board has an adjustable height by the balance seats and an adjustable curvature by the convex portion of each of the balance seats, so that the exercising balance board is available for users of different statures and requirements, thereby enhancing the versatility of the exercising balance board.

A further objective of the present invention is to provide an exercising balance board, wherein the locking strips of the mounting recess of the balance seat are locked on the locking strips of the mounting portion of the pedal, so that the balance seat is mounted on the pedal rigidly and stably.

Further benefits and advantages of the present invention will become apparent after a careful reading of the detailed description with appropriate reference to the accompanying drawings.

DETAILED DESCRIPTION OF THE INVENTION

Figure 1:
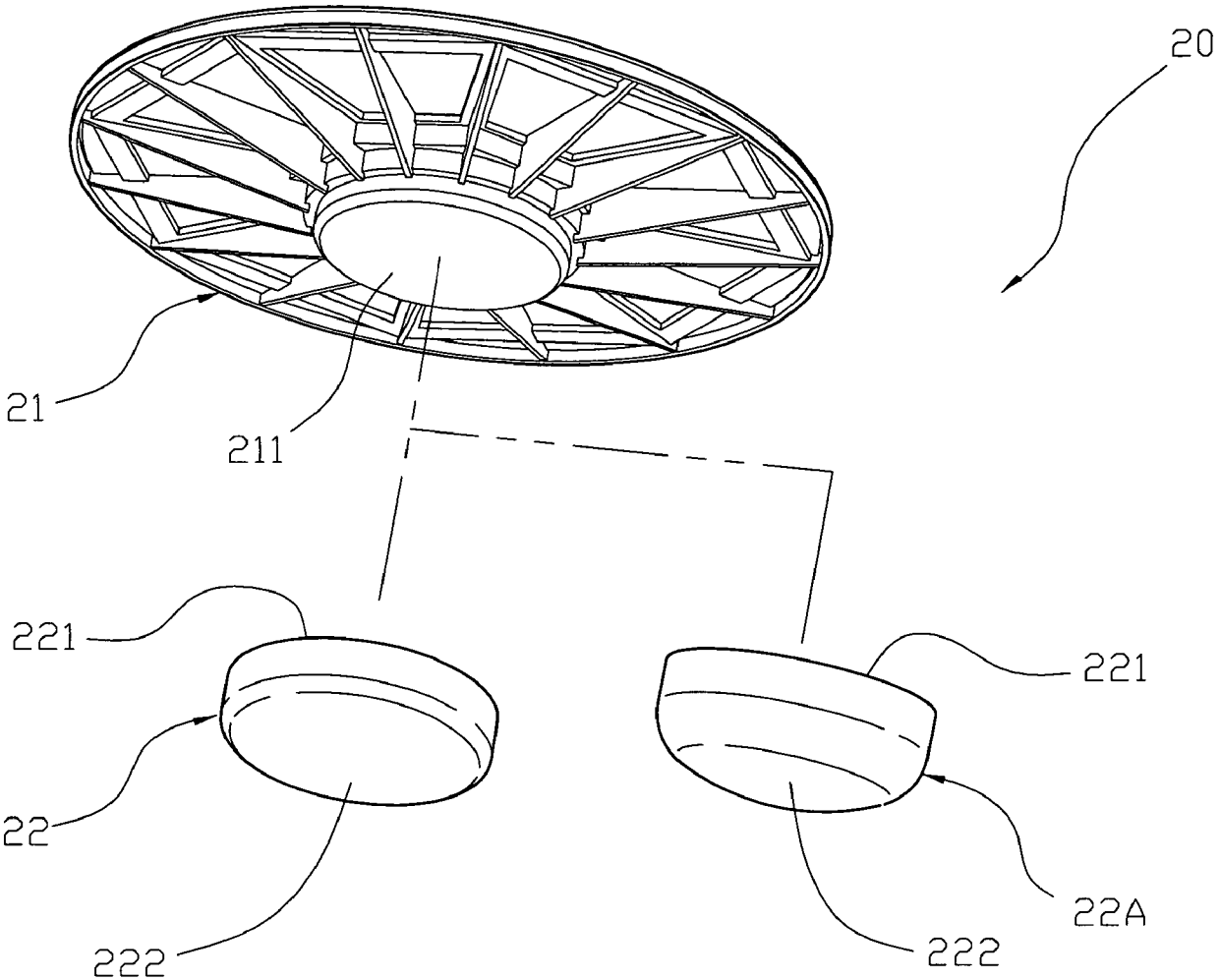
FIG. 1 is an exploded perspective view of an exercising balance board in accordance with the preferred embodiment of the present invention.
Figure 2:
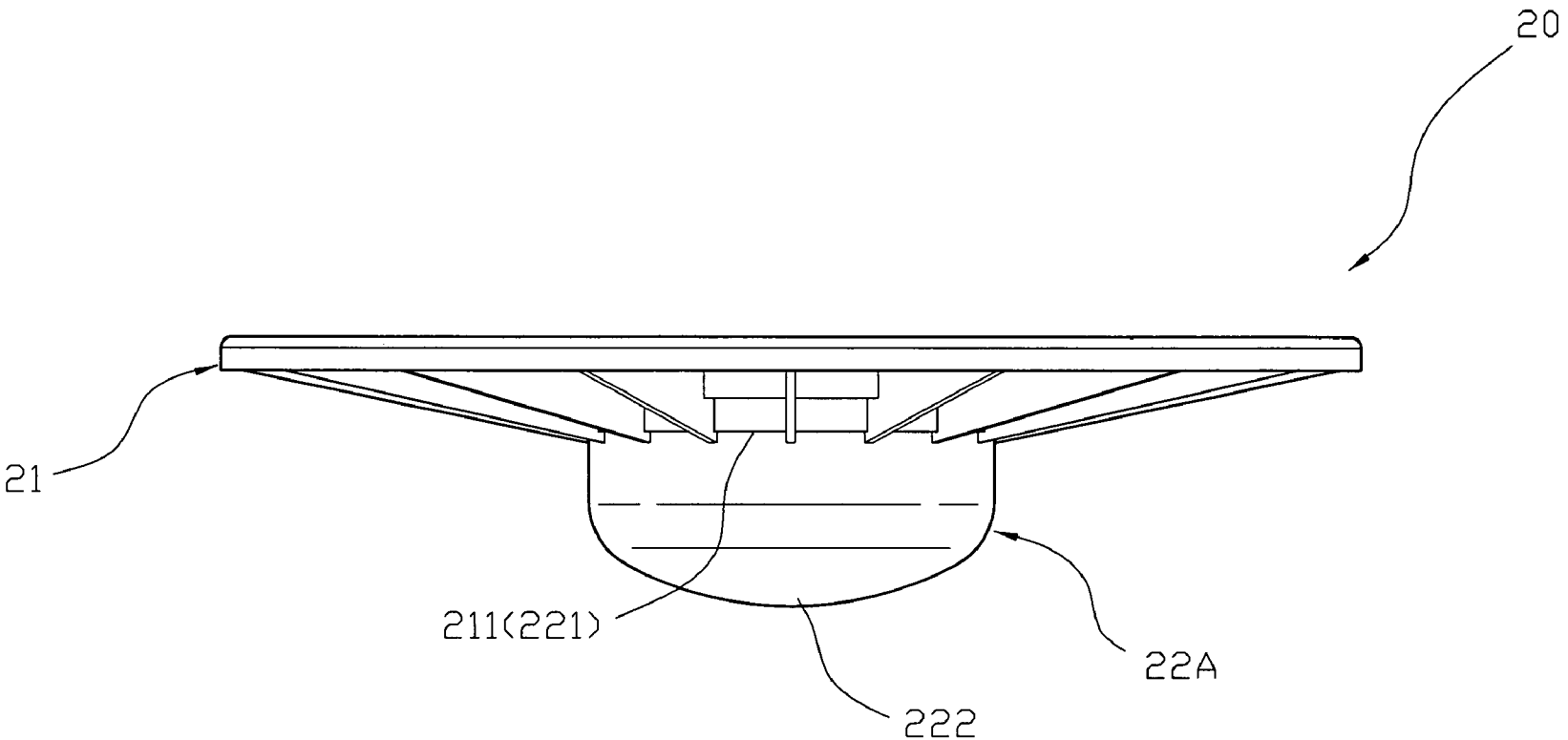
FIG. 2 is a plan cross-sectional assembly view of the exercising balance board as shown in FIG. 1.
Figure 3:
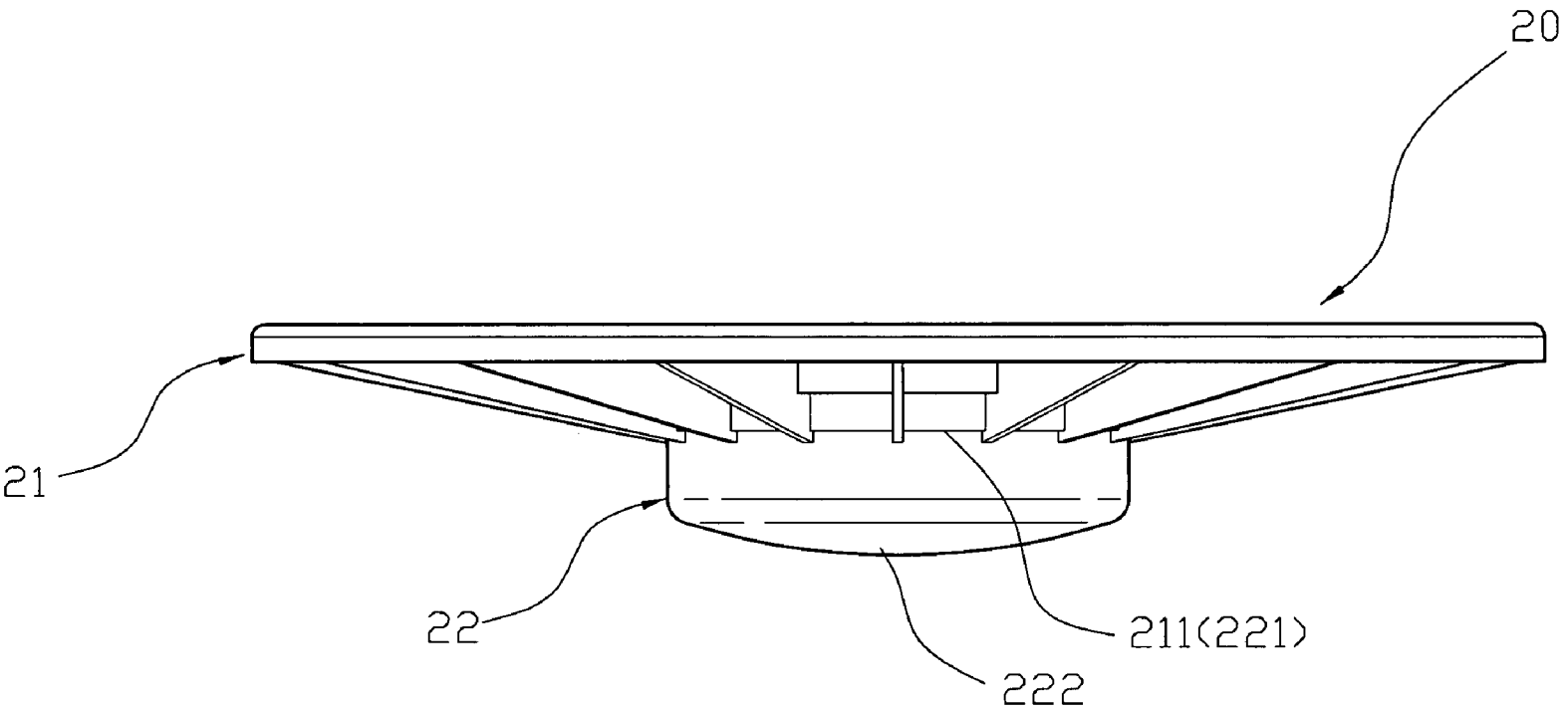
FIG. 3 is a plan cross-sectional assembly view of the exercising balance board as shown in FIG. 1.

Referring to the drawings and initially to FIGS. 1-3, an exercising balance board 20 in accordance with the preferred embodiment of the present invention comprises a pedal 21, and a plurality of balance seats 22 and 22A selectively mounted on a bottom of the pedal 21.

The bottom of the pedal 21 is formed with a protruding mounting portion 211 having a substantially circular shape.

Each of the balance seats 22 and 22A has a different height. Each of the balance seats 22 and 22A has a first portion formed with a mounting recess 221 selectively mounted on the mounting portion 211 of the pedal 21 to attach each of the balance seats 22 and 22A to the pedal 21 and a second portion formed with a convex portion 222. The mounting recess 221 of each of the balance seats 22 and 22A has a substantially circular shape. The convex portion 222 of each of the balance seats 22 and 22A has a different curvature.

As shown in FIG. 2, the balance seat 22A is selectively mounted on the bottom of the pedal 21.

As shown in FIG. 3, the balance seat 22 is selectively mounted on the bottom of the pedal 21.

Thus, the exercising balance board has an adjustable height by the balance seats 22 and 22A and an adjustable curvature by the convex portion 222 of each of the balance seats 22 and 22A, so that the exercising balance board is available for users of different statures and requirements, thereby enhancing the versatility of the exercising balance board.

Figure 4:
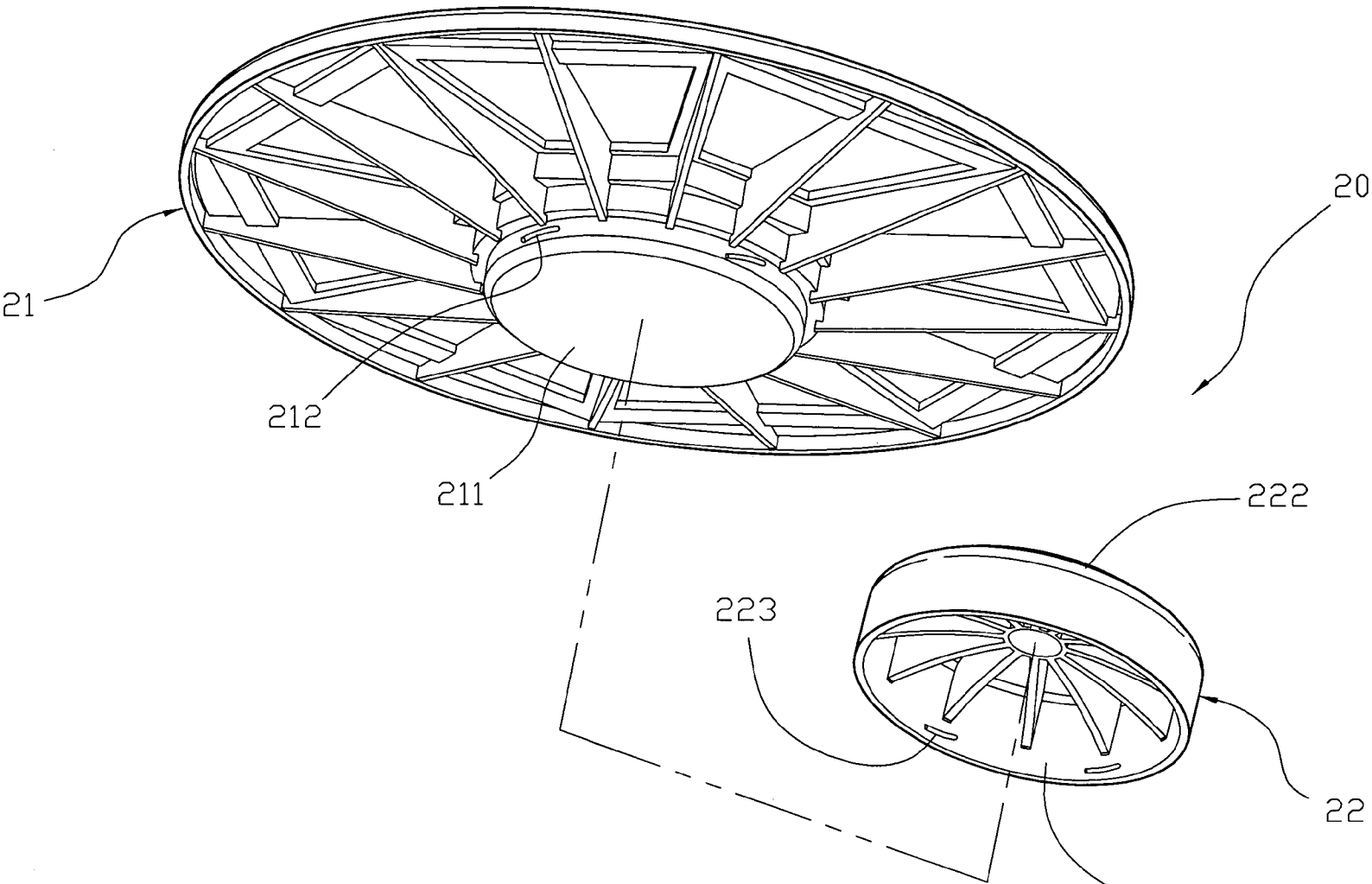
FIG. 4 is an exploded perspective view of an exercising balance board in accordance with another preferred embodiment of the present invention.
Figure 6:
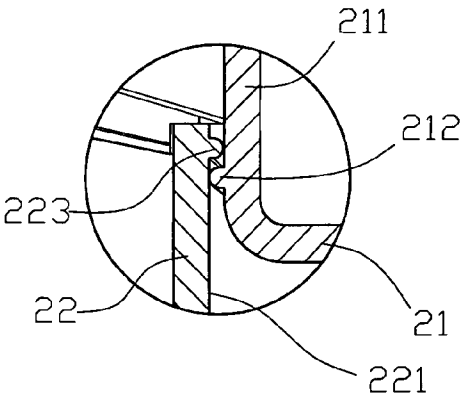
FIG. 6 is a locally enlarged view of the exercising balance board as shown in FIG. 5.
Figure 5:
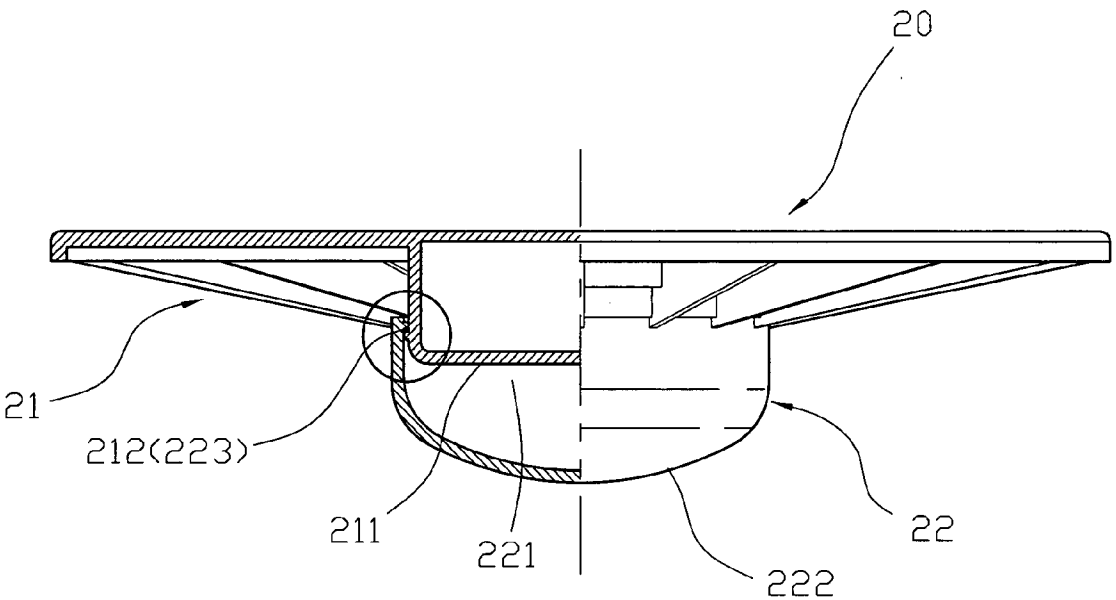
FIG. 5 is a partially plan cross-sectional assembly view of the exercising balance board as shown in FIG. 4.
Figure 7:
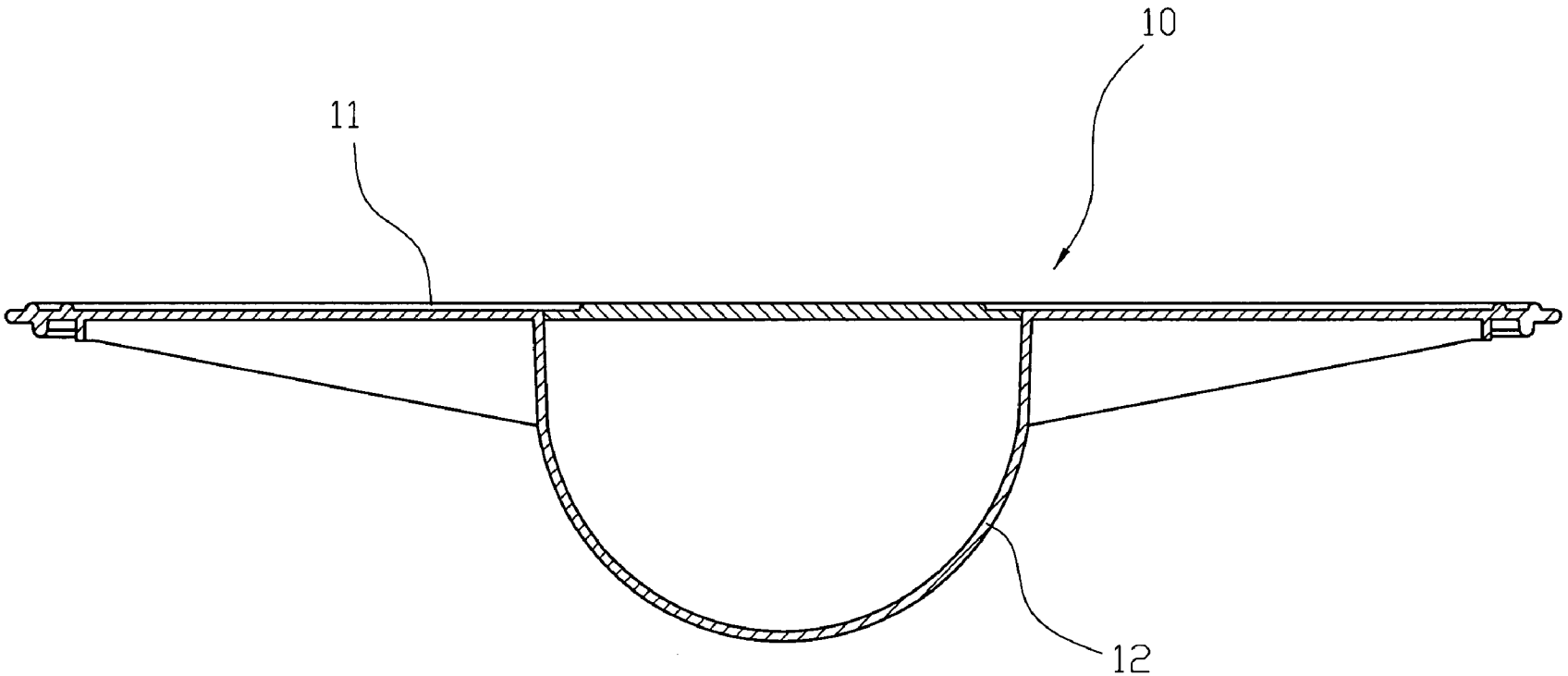
FIG. 7 PRIOR ART
FIG. 7 is a plan cross-sectional view of a conventional exercising balance board in accordance with the prior art.

Referring to FIGS. 4-6, the mounting portion 211 of the pedal 21 has a periphery provided with a plurality of locking strips 212, and the mounting recess 221 of the balance seat 22 has a periphery provided with a plurality of locking strips 223 locked on the locking strips 212 of the mounting portion 211 of the pedal 21, so that the balance seat 22 is mounted on the pedal 21 rigidly and stably. The locking strips 223 of the mounting recess 221 of the balance seat 22 are locked on the locking strips 212 of the mounting portion 211 of the pedal 21 by rotation of the balance seat 22 relative to the pedal 21. The locking strips 223 of the mounting recess 221 of the balance seat 22 are arranged in an annular manner and equally distant from each other, and the locking strips 212 of the mounting portion 211 of the pedal 21 are arranged in an annular manner and equally distant from each other.

Accordingly, the exercising balance board has an adjustable height by the balance seats 22 and 22A and an adjustable curvature by the convex portion 222 of each of the balance seats 22 and 22A, so that the exercising balance board is available for users of different statures and requirements, thereby enhancing the versatility of the exercising balance board. In addition, the locking strips 223 of the mounting recess 221 of the balance seat 22 are locked on the locking strips 212 of the mounting portion 211 of the pedal 21, so that the balance seat 22 is mounted on the pedal 21 rigidly and stably.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. An exercising balance board, comprising:

a pedal;

a plurality of balance seats selectively mounted on a bottom of the pedal;

wherein the bottom of the pedal is formed with a protruding mounting portion, and each of the balance seats has a first portion formed with a mounting recess selectively mounted on the mounting portion of the pedal to attach each of the balance seats to the pedal;

wherein the mounting portion of the pedal has a periphery provided with a plurality of locking strips, and the mounting recess of each of the balance seats has a periphery provided with a plurality of locking strips locked on the locking strips of the mounting portion of the pedal;

wherein the locking strips of the mounting recess of each of the balance seats are locked on the locking strips of the mounting portion of the pedal by rotation of each of the balance seats relative to the pedal.

2. The exercising balance board in accordance with claim 1, wherein each of the balance seats has a different height.

3. The exercising balance board in accordance with claim 1, wherein the mounting portion of the pedal has a substantially circular shape.

4. The exercising balance board in accordance with claim 1, wherein the mounting recess of each of the balance seats has a substantially circular shape.

5. The exercising balance board in accordance with claim 1, wherein each of the balance seats has a second portion formed with a convex portion.

6. The exercising balance board in accordance with claim 5, wherein the convex portion of each of the balance seats has a different curvature.

7. The exercising balance board in accordance with claim 2, wherein the exercising balance board has an adjustable height by the balance seats.

8. The exercising balance board in accordance with claim 6, wherein the exercising balance board has an adjustable curvature by the convex portion of each of the balance seats.

9. The exercising balance board in accordance with claim 1, wherein the locking strips of the mounting recess of each of the balance seats are arranged in an annular manner.

10. The exercising balance board in accordance with claim 1, wherein the locking strips of the mounting recess of each of the balance seats are equally distant from each other.

11. The exercising balance board in accordance with claim 1, wherein the locking strips of the mounting portion of the pedal are arranged in an annular manner.

12. The exercising balance board in accordance with claim 1, wherein the locking strips of the mounting portion of the pedal are equally distant from each other.

* * * * *